US006129126A

United States Patent [19]

Restivo

[11] Patent Number: 6,129,126

[45] Date of Patent: Oct. 10, 2000

[54] HANDBAG WITH INTERCHANGEABLE DECORATIVE DISPLAY PANELS

[76] Inventor: Elissa S. Restivo, 90 Gardiners Bay Dr., P.O. Box 838, Shelter Island Heights, N.Y. 11965

[21] Appl. No.: 09/316,112

[22] Filed: May 24, 1999

[51] Int. Cl.[7] ..... A45C 3/08; A45C 13/08

[52] U.S. Cl. ..... 150/105; 150/104; 150/113; 383/111

[58] Field of Search ..... 150/103–105, 150/113; 190/26, 110; 383/111

[56] References Cited

U.S. PATENT DOCUMENTS

| | | | |
|---|---|---|---|
| 1,990,360 | 2/1935 | Anish . | |
| 2,053,464 | 9/1936 | Dalsheim | 150/105 |
| 3,182,701 | 5/1965 | Ginsburg | 150/105 |
| 4,907,633 | 3/1990 | Eckstein | 150/105 |
| 5,009,319 | 4/1991 | Jantzen | 150/105 X |
| 5,207,254 | 5/1993 | Fromm | 150/104 |

FOREIGN PATENT DOCUMENTS

| | | | |
|---|---|---|---|
| 2406969 | 6/1979 | France | 150/104 |
| 2629794 | 10/1989 | France | 150/103 |
| 635036 | 3/1950 | United Kingdom | 150/103 |
| 952542 | 3/1964 | United Kingdom | 150/105 |
| 1089413 | 11/1967 | United Kingdom | 150/105 |
| 9307777 | 4/1993 | WIPO | 150/105 |

*Primary Examiner*—Sue A. Weaver
*Attorney, Agent, or Firm*—Myron Amer PC

[57] ABSTRACT

Adding a decorative panel in a display position about a handbag by positioning opposite panel edges beneath front and rear fold-down flaps, the contacting surfaces of the flaps and panel edges being firmly secured to each other to an extent obviating inadvertent release of a flap during use as might result from snagging, and yet manual release is well within the strength of the user preparatory to changing a display panel.

1 Claim, 1 Drawing Sheet

HANDBAG WITH INTERCHANGEABLE DECORATIVE DISPLAY PANELS

The present invention relates generally to improvements, using a selected one of available decorative panels, in the practice of a known method of adding the selected panel in a display position about the handbag, the improvements more particularly obviating inadvertent release of the decorative panel during normal use of the handbag, and also contributing to the ease of substituting or interexchanging one panel for another, as required by the fashion objective of the handbag user.

EXAMPLES OF THE PRIOR ART

To satisfy a range of fashion objectives in the use of a handbag, i.e., to provide the handbag with an appearance or look that is sporty, or formal, or coordinated with shoes or clothing accessories, and the like, it is already known from numerous prior patents that these fashion possibilities can be achieved using a selected one of available decorative panels attached to the handbag, these prior patents being exemplified by U.S. Pat. No. 2,627,885 issued to S. L. Cassell for "Lady's Handbag" on Feb. 10, 1953, U.S. Pat. No. 2,000,538 issued to M. H. Resnick for "Hand Bag and Reversible Cover therefore" on May 7, 1935, U.S. Pat. No. 2,131,382 issued to R. Lobel for "Handbag" on Sep. 27, 1938, and U.S. Pat. No. 3,182,701 issued to A. Ginsburg for "Multiple Face Handbag" on May 11, 1965, to mention but a few.

Singled out from the above and all other known prior patents is U.S. Pat. No. 1,990,360 issued to A. Anish for "Lady's Hand Bag" on Feb. 5, 1935, in which the method of positioning the decorative panel for display about the handbag contemplates the use of front and rear fold-down flaps over the upper edges of the display panel and a connection therebetween using snap fasteners on the underside of the flaps, and cooperating snap fasteners on the decorative panel.

In the '360 method of decorating the handbag, each folded-down flap is vulnerable to inadvertent release, as might result from snagging particularly in locations between the snap fasteners. Also, the folding down of a flap to achieve interconnection of the cooperating snap fasteners results in a position of movement of the flap which masks from view the snap fasteners on the handbag thus correspondingly making alignment therebetween difficult. Still further, finger pressure is required to snap the fasteners together, and inadvertently the finger pressure makes undesirable marks or impressions on the exterior surfaces of the flaps.

Underlying the present invention is the recognition that an interconnection between the contacting surfaces of the flaps and of the decorative panel can be achieved to an extent of firmness that obviates inadvertent release, and that such firmness nevertheless does not interfere with removal and substituting a decorative panel because a manual force appropriate for release is readily applied by the user. Stated somewhat differently, the flap opened by a manually applied force occurs during a change of decorative panel and thus the open condition thereof does not adversely affect the appearance or use of the handbag, which is not the case of a flap which is snagged open.

Broadly, it is an object of the present invention to provide a method of decorating a handbag using a selected decorative panel overcoming the foregoing and other shortcomings of the prior art.

More particularly, it is an object to provide a firm enough connection extending the width of the handbag between the flaps and decorative panel, and yet well within the strength of a typical user to manually release, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a front perspective view of a handbag, of which a rear perspective view is a substantial duplicate, and illustrating the handbag in a condition in which the front and rear panels thereof are essentially devoid of decoration;

FIG. 2, like FIG. 1, shows front and rear perspective views of the handbag, but illustrating a panel added thereto for decoration;

Figure 1:
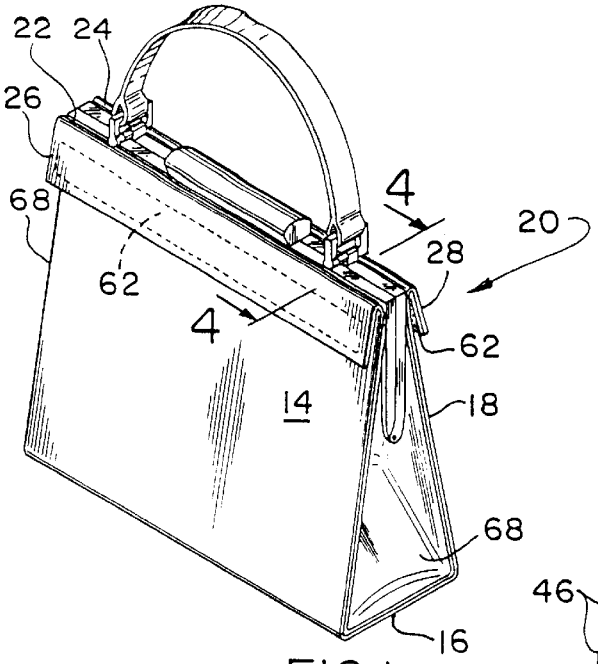
Figure 2:
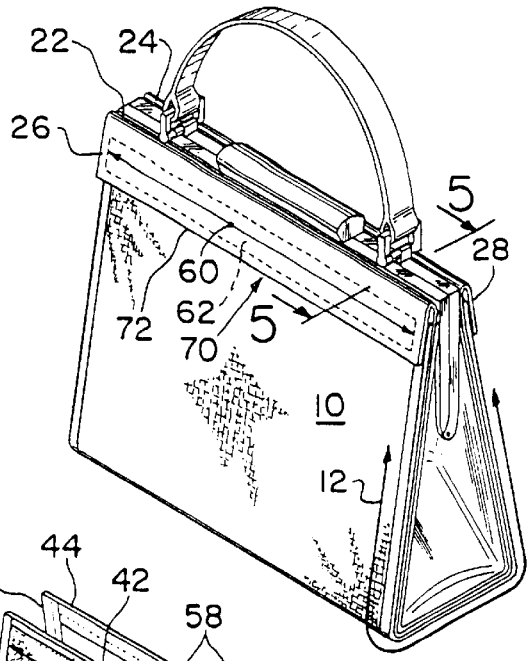
Figure 3:
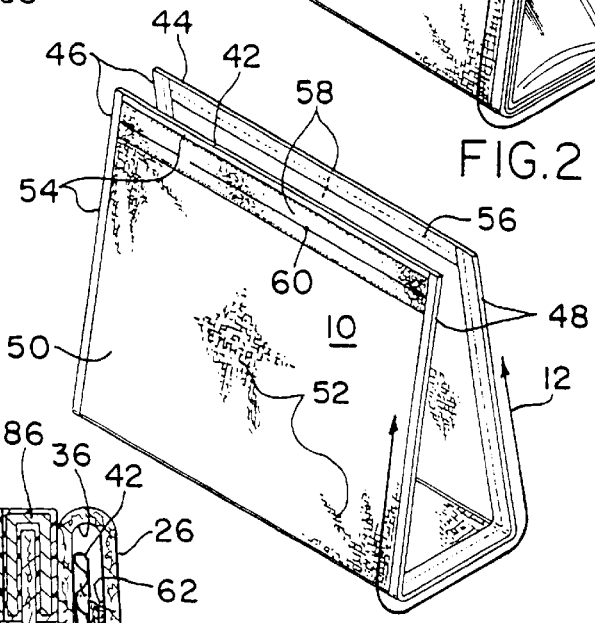
FIG. 3 is an isolated perspective view of an exemplary added decorative panel shown in FIG. 2.

A solution to a long unsolved problem is the described method which follows of attaching a selected one of many decorative panels, of which panel 10 is to be understood to be only exemplary, in a U-shaped or encircling relation, as generally noted at 12, about a front panel 14, bottom panel 16, and rear panel 18 of a handbag generally designated 20.

Obviated in the problem-solving method is any unintentional release of the selected panel 10 during normal use of the handbag 20 and contributing to the ease of substituting or interexchanging one panel 10 for another, as required by the fashion objective of the purchaser, i.e., to have a handbag with a look that is sporty, formal, color coordinated with shoes or clothing accessories, and the like.

In the manufacture of the handbag 20 there is extending from upper edges 22, 24 of the front and rear panels 14, 18 by an added dimension or otherwise in any appropriate manner a front flap 26 and a rear flap 28, the flaps' attachment being coincident with the respective top edges of the front and rear panels 30, 32, and also establishing by a reverse in curvature, aptly denominated positioning sites 34 and 36. Each flap 26 and 28 extends from a cooperating site 34, 36 and is adapted to partake of a closing pivotal movement 38 over the tops of the panels 14 and 18, and also in an opposite pivotal movement 40 in which it assumes an open position, in which position the established positioning sites 34 and 36 are exposed.

Each panel 10 is designed and/or styled as a separate article of manufacture, having a rectangular shape, in a preferred embodiment being 8¾"×17", delimited by a top edge 42, a bottom or opposite edge 44, and opposite side edges 46 and 48. An outwardly facing surface 50 of panel 10 is embodied with a design 52 providing the desired fashion look of the panel 10.

Along the top and bottom edges 42 and 44 of panel 10, there is sewn in place under folded down hems, individually and collectively designated 54, by top stitching 56, VELCRO strips of hook and loop-type fasteners 58. It is to be noted that the hook and loop-type fastener strips 58 are rectangular in shape and that the long dimension 60 thereof is oriented widthwise of the handbag front and rear panel edges 30 and 32.

Figure 4:
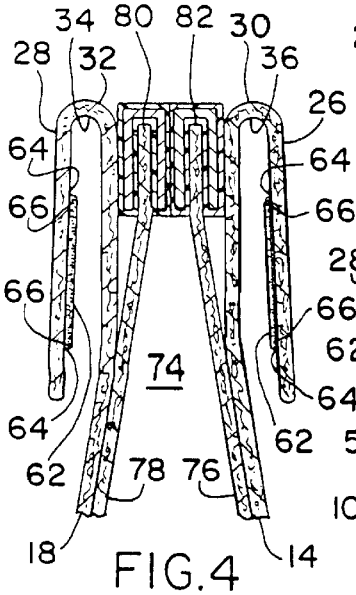
FIG. 4 is a partial side elevational view in cross section as taken along line 4—4 of FIG. 1.
Figure 5:
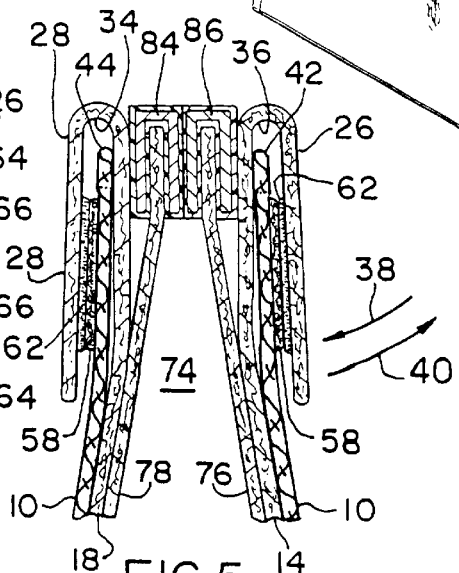
FIG. 5 is a partial side elevational view in cross section as taken along line 5—5 of FIG. 2.

Cooperating with the VELCRO strips 58 on the underside of flaps 26, 28 are selected cooperating rectangular VEL- CRO hook and loop-type fastener strips 62 (FIG. 4) sewn in place at location 64 by top stitching 66, or adhesive attachment, the selected dimensions of strips 62 being the same or substantially the same as the strips 58. Also as to be noted, each strip 58, 62 is oriented widthwise of the handbag 20. Thus the strips 58 and 62 correspondingly are to adapted attach to each other across the entire or substantially the entire width of the handbag 20.

The front top and rear top edges 42, 44 are positioned beneath a cooperating front and rear flap 26, 28 and to guide these edges 42, 44 into a desired position preparatory to use, the panel 10 is projected beneath an open flap 26, 28 until assuming close operative positions adjacent the respective positioning sites 34 and 36. The panel 10 is then in a desired U-shape configuration 12 about the handbag 20 and by "eye" is readily centered between the opposite sides, individually and collectively designated 68 of the front and rear panels 14, 18. The attachment method is then completed by closing movement 38 of the flaps 26 and 28 upon the panel edges 42, 44 seated at their positioning sites 34, 36, and bringing into engagement with each other the strips 58 and 62 for the full extent of the width of the handbag 20. This fall width of a flap 26, 28 upon the seated top edges 42 and 44 of a display panel 10 has been found in practice to obviate, during normal use of the handbag 20, any inadvertent opening of a flap 26, 28 due to snagging, particularly along a medial location, generally designated 70, of a flap edge 72, and this is undoubtedly due to the firmness of the attachment to each other of the VELCRO strips 58 and 62.

This firmness of the attachment or securement of the closed flaps 26, 28 however is readily within the strength of the handbag user to manually release, preparatory to removing the panel 10 from its display position and repeating the aforesaid positioning method for a substitute display panel 10.

For completeness sake it is noted that handbag 20 includes an inner compartment 74 bounded by inner front and rear panels 76 and 78 having upper edges 80 and 82 which are crimped into metal frames 84 and 86 which move apart from their illustrated position to provide an access opening into the compartment 74.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of decorating a handbag comprising the steps of:

A. selecting for decoration a handbag having an interior compartment of a specified width bounded by opposite front and rear panels initially devoid of decoration;

B. establishing along each of upper edges for the entire width of said front and rear panels a positioning site;

C. extending a first flap and a second flap only from a respective positioning site and otherwise unattached so as to enable said flaps to partake of opposite opening and closing pivotal movements about said positioning sites;

D. selecting as a separate article of manufacture a rectangular shaped decorative panel of said same width of said front and rear panels and having a hook and loop-type fastener strip for the entire of said width along opposite horizontally oriented edges thereof;

E. connecting a hook and loop-type fastener strip on an underside of said first and second flaps for the entire width thereof;

F. locating said opposite horizontally oriented edges of said decorative panel adjacent to said positioning site; and G. urging said first and second flaps through said closing movements thereof about said positioning sites while said opposite edges of said decorative panel are located thereat, whereby said locations of a hook and loop-type fastener strips are brought by said closing movement into facing relation with each other alone the entire width thereof to contribute to securely holding in place said decorative panel in an encircling display position about said handbag.

* * * * *